US011369816B2

(12) United States Patent
Carrasca et al.

(10) Patent No.: US 11,369,816 B2
(45) Date of Patent: Jun. 28, 2022

(54) POSITIONABLE CONNECTOR ASSEMBLY

(71) Applicant: Pure Safety Group, Inc., Pasadena, CA (US)

(72) Inventors: Robert G. Carrasca, Seattle, WA (US); Christopher Ross Hamlin, Seattle, WA (US); Dylan James Piper-Kaiser, Seattle, WA (US); Kathryn Rose Crabb, Vancouver, WA (US)

(73) Assignee: Pure Safety Group, Inc., Pasadena, TX (US)

( * ) Notice: Subject to any disclaimer, the term of this patent is extended or adjusted under 35 U.S.C. 154(b) by 359 days.

(21) Appl. No.: 16/393,389

(22) Filed: Apr. 24, 2019

(65) Prior Publication Data

US 2019/0329077 A1 Oct. 31, 2019

Related U.S. Application Data

(60) Provisional application No. 62/662,809, filed on Apr. 26, 2018.

(51) Int. Cl.
*A62B 35/00* (2006.01)

(52) U.S. Cl.
CPC ..... *A62B 35/0037* (2013.01)

(58) Field of Classification Search
CPC ..... A62B 35/0025; A62B 35/0037; A62B 35/0031; B60P 7/0807
See application file for complete search history.

(56) References Cited

U.S. PATENT DOCUMENTS

| | | | | |
|---|---|---|---|---|
| 1,838,139 | A | 12/1931 | Fitch | |
| 1,877,704 | A | 9/1932 | Switlik | |
| 2,372,558 | A | 3/1945 | Dowd | |
| 2,833,454 | A | 5/1958 | McGee | |
| 4,630,982 | A * | 12/1986 | Fenner | B61D 45/001 410/102 |
| 5,248,176 | A | 9/1993 | Fredricksson | |
| 5,286,130 | A * | 2/1994 | Mueller | B66C 1/66 294/215 |
| 5,774,948 | A | 7/1998 | Petschke et al. | |
| 6,073,724 | A * | 6/2000 | Wolner | A62B 35/0087 182/3 |
| 6,125,966 | A | 10/2000 | Jones | |
| 6,253,874 | B1 | 7/2001 | Casebolt et al. | |

(Continued)

FOREIGN PATENT DOCUMENTS

EP 3017847 A1 5/2016

OTHER PUBLICATIONS

MSA, EVOTECH Harnesses, accessed on Oct. 25, 2019 at us.msasafety.com/Fall-Protection/Full-Body-Harness/EVOTECH%C2%AE-Harnesses/p/00023000020000101 8, known of prior to Apr. 26, 2018, 4 pages.

(Continued)

*Primary Examiner* — Colleen M Chavchavadze
(74) *Attorney, Agent, or Firm* — Dicke, Billig & Czaja, PLLC

(57) ABSTRACT

A positionable connector assembly comprises a base, a connector operatively connected to the base, a friction member positioned between the base and the connector, and a biasing member operatively connected to the connector and configured and arranged to bias the connector toward the friction member.

17 Claims, 5 Drawing Sheets

(56) References Cited

U.S. PATENT DOCUMENTS

| | | | | |
|---|---|---|---|---|
| 6,533,512 | B2 * | 3/2003 | Lin | B60P 7/0807 410/102 |
| 6,592,310 | B2 | 7/2003 | Hyp et al. | |
| 7,073,627 | B2 | 7/2006 | Casebolt et al. | |
| 7,178,632 | B2 | 2/2007 | Casebolt et al. | |
| 8,177,025 | B2 | 5/2012 | Lang et al. | |
| 8,245,817 | B2 * | 8/2012 | Casebolt | A62B 1/10 182/231 |
| 8,272,073 | B2 | 9/2012 | Arensdorf et al. | |
| 8,727,073 | B2 * | 5/2014 | Lang | A62B 35/0018 182/3 |
| 9,427,608 | B2 | 8/2016 | Fink et al. | |
| 9,664,224 | B2 * | 5/2017 | Ivanic | B60P 7/0807 |
| 10,112,064 | B2 * | 10/2018 | Bouquier | A62B 35/0012 |
| 10,232,199 | B2 * | 3/2019 | Perner | A62B 35/0031 |
| 10,343,001 | B2 * | 7/2019 | Seman | A62B 35/0043 |
| 2006/0102423 | A1 * | 5/2006 | Lang | A62B 35/04 182/36 |
| 2016/0089554 | A1 | 3/2016 | Perner | |
| 2016/0361579 | A1 | 12/2016 | Casebolt et al. | |
| 2017/0120087 | A1 | 5/2017 | Cowell et al. | |
| 2017/0291046 | A1 | 10/2017 | Bouquier | |
| 2019/0069644 | A1 * | 3/2019 | Hetrich | A44B 11/28 |

OTHER PUBLICATIONS

MSA, EVOTECH Full-Body Harnesses, Sep. 2014, 12 pages.

* cited by examiner

POSITIONABLE CONNECTOR ASSEMBLY

This application claims the benefit of U.S. Provisional Patent Application 62/662,809, filed Apr. 26, 2018, incorporated by reference herein.

BACKGROUND

Fall protection equipment is commonly used to reduce a likelihood of a fall and/or injuries associated with a fall, particularly by users who perform tasks at heights or are at risk of falling. Generally, lifelines or lanyards typically interconnect anchorage structures and safety harnesses donned by users. The lifelines or lanyards allow the users to move and perform tasks while being connected to the anchorage structures. Should a user fall, the lifeline or lanyard limits the distance the user falls.

A user often connects a lifeline or a lanyard to a dorsal D-ring positioned on the back of the user's safety harness. To connect and disconnect the lifeline or lanyard, it may be difficult if the D-ring is in a downward position relative to the user. There are other positions on the safety harness where a positionable D-ring would be useful.

For the reasons stated above and for other reasons stated below, which will become apparent to those skilled in the art upon reading and understanding the present specification, there is a need in the art for a positionable D-ring assembly.

BRIEF SUMMARY

The above-mentioned problems associated with prior devices are addressed by embodiments of the disclosure and will be understood by reading and understanding the present specification. The following summary is made by way of example and not by way of limitation.

In one embodiment, a positionable connector assembly comprises a base, a connector operatively connected to the base, a friction member positioned between the base and the connector, and a biasing member operatively connected to the connector and configured and arranged to bias the connector toward the friction member.

In one embodiment, a positionable connector assembly comprises a base, a connector, a friction member, and a biasing member. The base includes a first extension and a second extension. The connector is operatively connected to the base, and the connector includes a connector portion pivotally connected to the base between the first extension and the second extension. The friction member is positioned between the first extension and the connector. The biasing member is positioned between the second extension and the connector and is configured and arranged to bias the connector toward the friction member.

In one embodiment method of positioning a connector of a connector assembly, the connector assembly includes a base, the connector is operatively connected to the base, a friction member is positioned between the base and the connector, and a biasing member is operatively connected to the connector and is configured and arranged to bias the connector toward the friction member. The connector is contacted and moved relative to the base to one of several positions, wherein a biasing force of the biasing member is overcome thereby reducing an amount of friction on the connector thereby allowing the connector to move. Once in the one of several position, the connector is released, wherein the biasing force biases the connector toward the friction member thereby holding the connector in the one of several positions relative to the base.

BRIEF DESCRIPTION OF THE DRAWINGS

The present disclosure can be more easily understood, and further advantages and uses thereof can be more readily apparent, when considered in view of the detailed description and the following Figures in which.

In accordance with common practice, the various described features are not drawn to scale but are drawn to emphasize specific features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration embodiments in which the disclosure may be practiced. It is to be understood that other embodiments may be utilized and mechanical changes may be made without departing from the spirit and scope of the present disclosure. The following detailed description is, therefore, not to be taken in a limiting sense.

Embodiments of the disclosure provide a positionable connector assembly.

Figure 1:
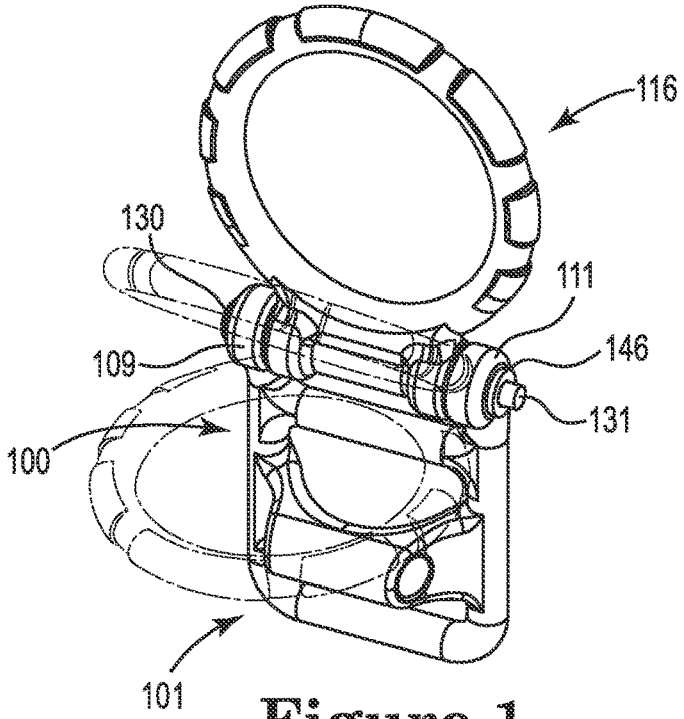
FIG. 1 is a perspective view of an embodiment positionable connector assembly.
Figure 2:
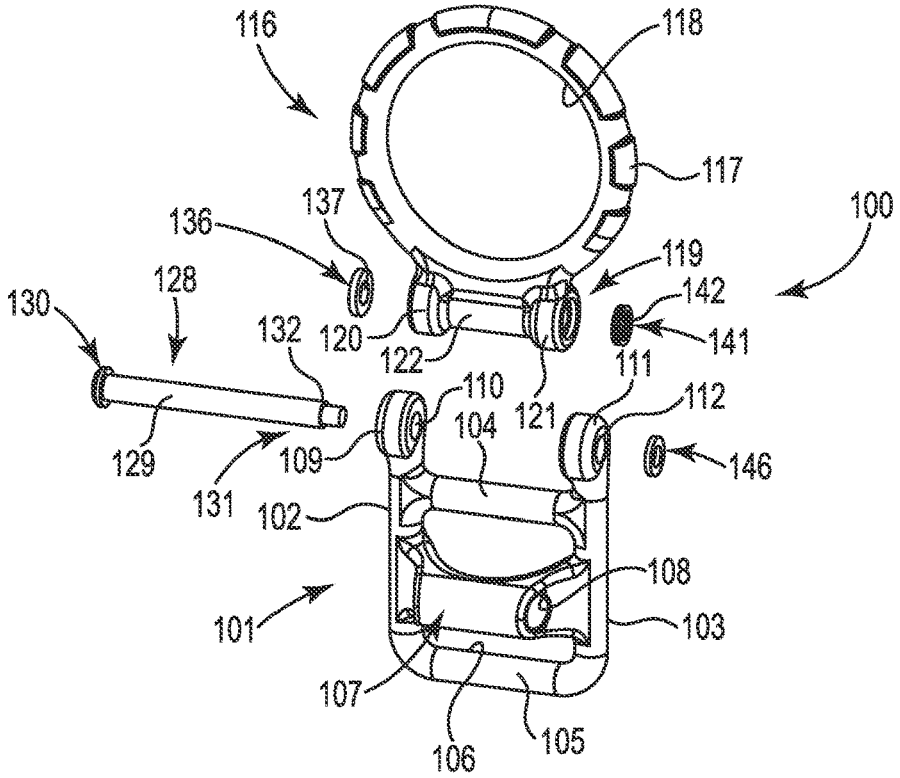
FIG. 2 is an exploded perspective view of the positionable connector assembly shown in FIG. 1.

An example embodiment is illustrated in FIGS. 1-2. A positionable connector assembly 100 includes a base 101 to which a connector 116 is connected. Generally, the positionable connector assembly 100 could be connected to straps of a safety harness proximate a user's back or other desired locations. It is recognized that any suitable base could be used and any suitable connector such as a D-ring could be used. Throughout the description, the terms connector and D-ring are interchangeable. For example, the base could have other configurations providing other ways to route straps of a safety harness and to connect to the connector, and the connector could have other configurations. Further, the positionable connector assembly could be used in a variety of locations on the safety harness.

Figure 3:
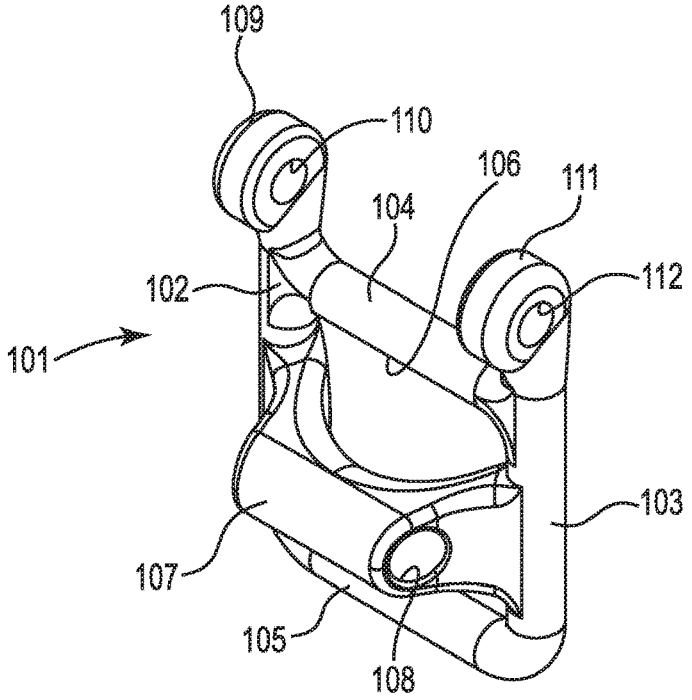
FIG. 3 is a perspective view of a base of the positionable connector assembly shown in FIG. 1.
Figure 4:
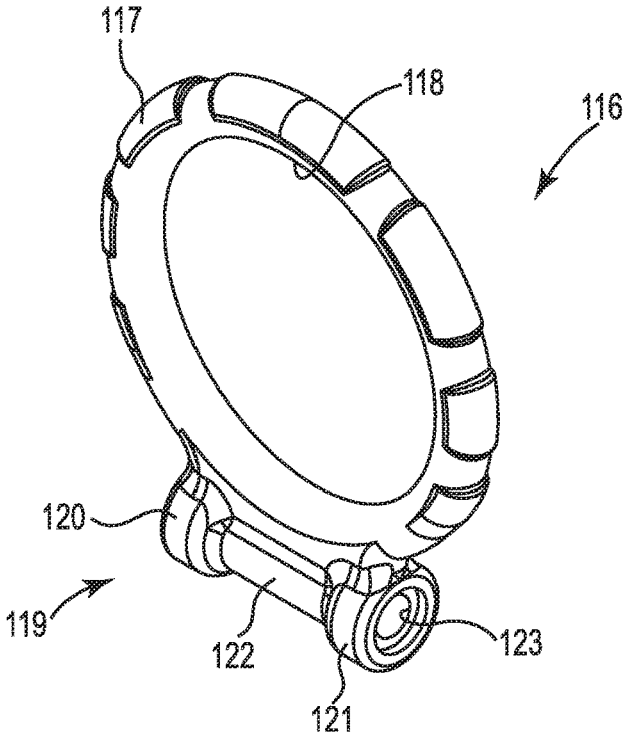
FIG. 4 is a perspective view of a connector of the positionable connector assembly shown in FIG. 1.
Figure 5:
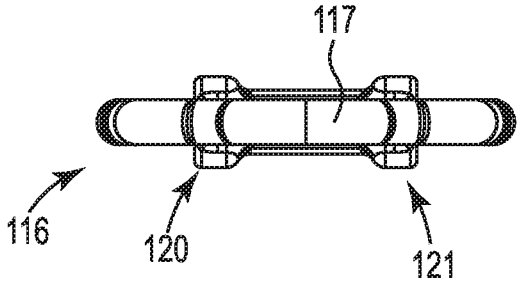
FIG. 5 is a top view of the connector shown in FIG. 4.
Figure 6:
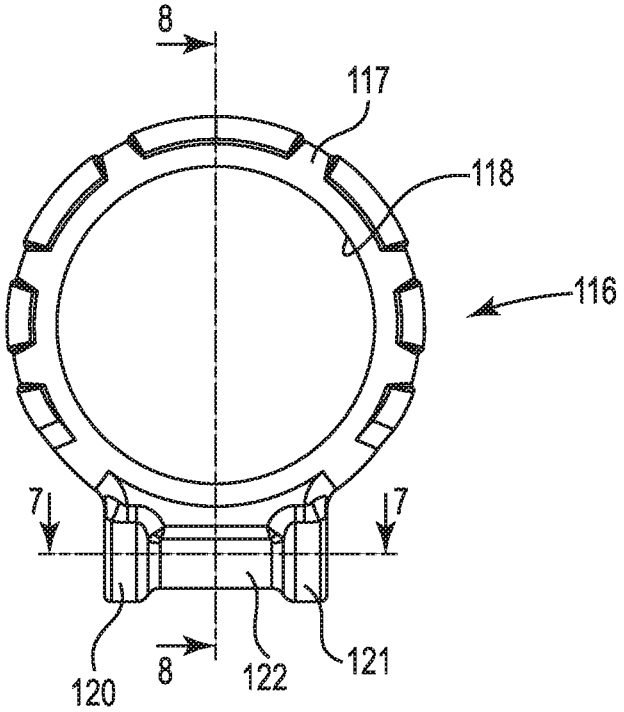
FIG. 6 is a front view of the connector shown in FIG. 4.
Figure 7:
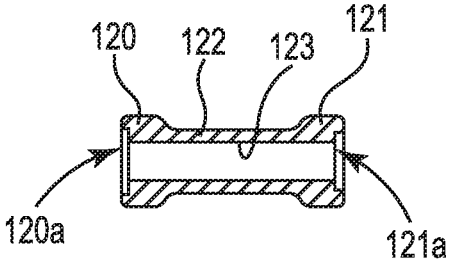
FIG. 7 is a cross section view of the connector shown in FIG. 6 taken along the lines 7-7.
Figure 8:
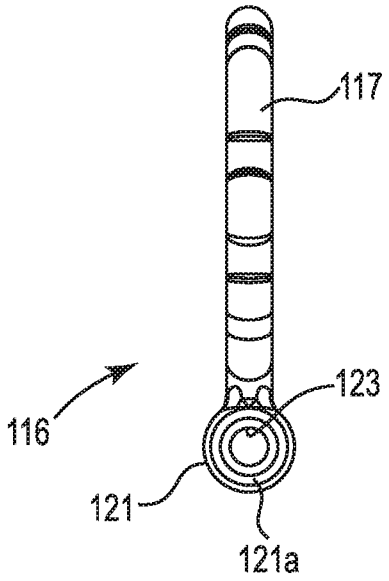
FIG. 8 is a cross section view of the connector shown in FIG. 6 taken along the lines 8-8.

The base 101 is generally U-shaped and includes a first side portion 102 and a second side portion 103 connected proximate the top by a first bar portion 104 and proximate the bottom by a second bar portion 105 to form an opening 106. A receiver 107 is connected to the first side portion 102 and the second side portion 103 between the first bar portion 104 and the second bar portion 105, and the receiver 107 including a cylindrical portion through which a receiver bore 108 extends. Extending upward from the first side portion 102 proximate the first bar portion 104 is a first extension 109, and extending upward from the second side portion 103 proximate the first bar portion 104 is a second extension 111. The first extension 109 includes a first aperture 110, the second extension includes a second aperture 112, and the first and second apertures 110 and 112 align. The base 101 is shown in FIG. 3. Although any suitable material may be used, preferably a light weight metal, such as aluminum, may be used.

Figure 10:
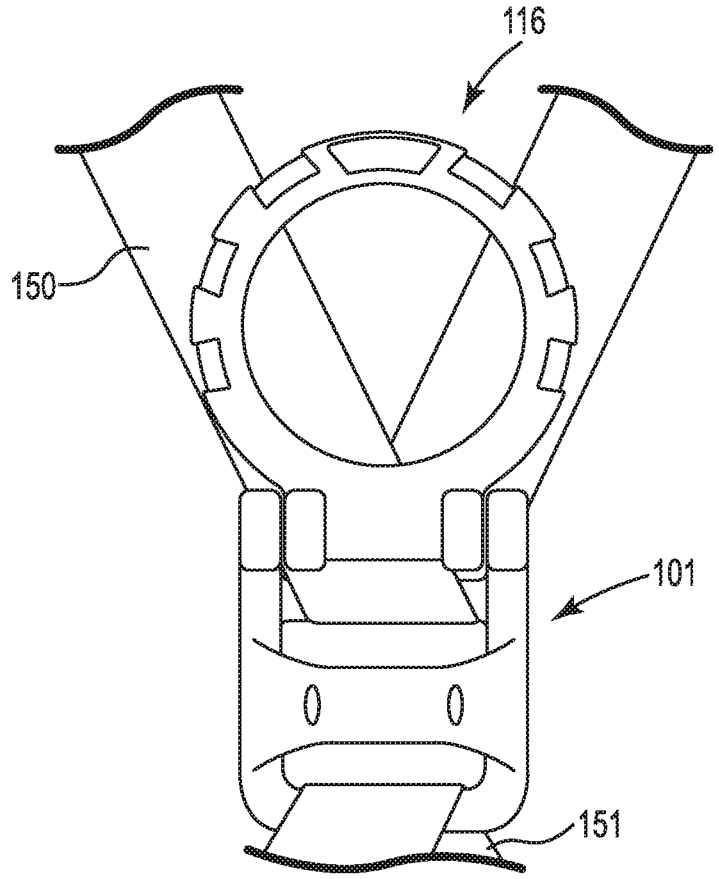
FIG. 10 is a plan view of an embodiment positionable connector assembly operatively connected to straps of an example safety harness.

A first strap 150 of a safety harness is routed about the first bar portion 104 to form the shoulder straps of the safety harness, and a second strap 151 of a safety harness is routed about the second bar portion 105 to form the back straps of the safety harness. This is shown in FIG. 10.

As shown in FIGS. 4-8, the connector 116 includes a ring portion 117 and a connector portion 119. The ring portion 117 is generally round, although any suitable configuration would be acceptable, and forms an opening 118. The bottom of the ring portion 117 is connected to the connector portion 119. Preferably, the ring portion 117 and the connector portion 119 are integral, but they could be two separate components operatively connected to one another. Although any suitable material may be used, preferably a light weight metal, such as aluminum, may be used.

The connector portion 119 is generally tubular shaped and includes an intermediate portion 122 interconnecting a first end portion 120 and a second end portion 121. A bore 123 extends longitudinally through the connector portion 119. The first end portion 120 includes a first receiving portion 120*a*, which is a recessed portion larger than the bore 123 but smaller than the outer diameter of the first end portion 120, and the second end portion 121 includes a second receiving portion 121*a*, which is a recessed portion larger than the bore 123 but smaller than the outer diameter of the second end portion 121. The first receiving portion 120*a* is configured and arranged to receive a friction member 136, and the second receiving portion 121*a* is configured and arranged to receive a biasing member 141. Alternatively, the friction member 136 and the biasing member 141 could be received within the first extension 109 and the second extension 111.

The friction member 136 is generally disc shaped and includes an aperture 137 aligning with the bore 123. Although the friction member 136 is generally disc shaped, it is recognized that any suitable friction member could be used. The friction member 136 could be made of any suitable material that provides friction such as but not limited to elastomers, composite materials, and textured materials.

Figure 9:
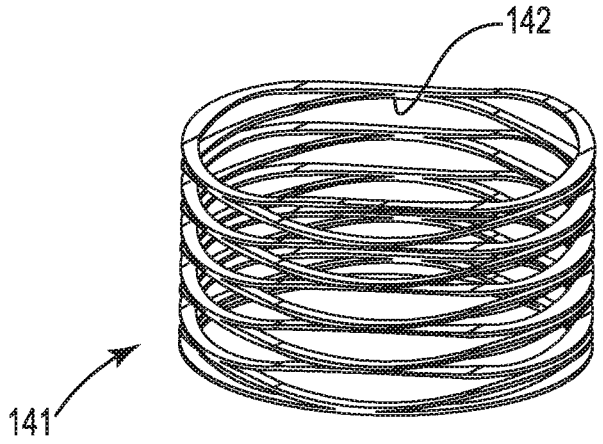
FIG. 9 is a perspective view of a biasing member of the positionable connector assembly shown in FIG. 1.

The biasing member 141 is preferably a coil spring including a bore 142 aligning with the bore 123. The coil spring could include waves, which assist in making the coil spring more compact. The biasing member 141 is shown in FIG. 9. It is recognized that any suitable biasing member such as but not limited to a compression spring, a leaf spring, and a magnet could be used.

The connector portion 119, in which the friction member 136 and the biasing member 141 are positioned, is configured and arranged to be received between the first extension 109 and the second extension 111 of the base 101. The bore 123 of the connector portion 119, the aperture 137 of the friction member 136, and the bore 142 of the biasing member 141 align with the first aperture 110 and the second aperture 112, and a fastener 128 extends therethrough to connect the connector portion 119 to the base 101.

The fastener 128 includes a shaft 129 to which a head 130 is operatively connected proximate one end. A distal end 131 includes a detent 132 configured and arranged to receive a retaining member 146. As illustrated in FIG. 1, the first extension 109 and the second extension 111 are captured between the head 130 and the retaining member 146. The connector 116 is pivotable about and movable along the fastener 128 relative to the base 101.

When thus assembled, the biasing member exerts force between the base and the connector, biasing the connector toward the friction member. In this example embodiment, the biasing member 141 pushes against the second extension 111 and the second end portion 121 and, because the connector 116 is movable along the fastener 128, the biasing member 141 biases the connector 116 away from the second extension 111 and toward the friction member 136. The friction member 136 is positioned between and contacts the first extension 109 and the first end portion 120 thereby providing frictional resistance to pivoting of the connector 116 relative to the base 101 when the connector 116 is biased toward the friction member 136.

To reposition the connector 116 relative to the base 101 in any one of several desired positions, the connector 116 may be manually pivoted about the fastener 128. During repositioning, the force of the biasing member 141 is at least partially overcome thereby reducing the amount of friction on the connector 116 and allowing the connector 116 to be pivoted into a desired position. Once in the desired position, regardless whether it is an upward or downward position relative to the user, the connector remains in that position until it is repositioned either manually or during use.

If the positionable connector assembly 100 is positioned proximate a user's back, to connect a safety device such as a lifeline or a lanyard to the connector 116, the user could position the connector 116 into a desired position either before or after donning the safety harness. In the desired position, the user more easily connects the safety device to the connector 116. During use, when a safety device is connected to the connector 116, the safety device could pivot and reposition the connector 116 relative to the base 101.

The above specification, embodiments, and data provide a complete description of the manufacture and use of the composition of embodiments of the disclosure. Although embodiments have been illustrated and described herein, it will be appreciated by those of ordinary skill in the art that any arrangement, which is calculated to achieve the same purpose, may be substituted for the embodiments. This application is intended to cover any adaptations or variations of the disclosure.

The invention claimed is:

1. A positionable connector assembly, comprising:

a base including a first extension and a second extension;

a connector operatively connected to the base, the connector including a connector portion pivotally connected to the base between the first extension and the second extension;

a friction member positioned between the first extension and the connector;

a biasing member positioned between the second extension and the connector and configured and arranged to bias the connector toward the friction member, the friction member and the biasing member being configured and arranged to allow a force exerted on the connector to pivot the connector relative to the base into a desired position, the desired position being any one of several positions, the connector remaining in the desired position when the force is released; and wherein the friction member is received within one of the connector and the first extension and the biasing member is received within one of the connector and the second extension.

2. The connector assembly of claim 1, wherein a fastener extends through the first extension, the friction member, the connector portion, the biasing member, and the second extension, the connector pivoting about the fastener.

3. The connector assembly of claim 1, wherein the biasing member is a coil spring.

4. The connector assembly of claim 3, wherein the coil spring includes waves.

5. The connector assembly of claim 1, wherein the friction member is made of a material selected from the group consisting of an elastomer, a composite material, and a textured material.

6. The connector assembly of claim 1, wherein the base is operatively connected to a safety harness.

7. The connector assembly of claim 1, wherein any one of several positions includes a first position and a second position, wherein the connector is pivotable from the first position to the second position.

8. The connector assembly of claim 7, wherein any one of several positions further includes a third position, wherein the connector is pivotable from the second position to the third position.

9. A positionable connector assembly, comprising:

a base including a first extension and a second extension;

a connector operatively connected to the base, the connector including a connector portion pivotally connected to the base between the first extension and the second extension;

a friction member positioned between the first extension and the connector;

a biasing member positioned between the second extension and the connector and configured and arranged to bias the connector toward the friction member; and a fastener extending through the first extension, the friction member, the connector portion, the biasing member, and the second extension, the connector being pivotable about the fastener relative to the base, the biasing member biasing the connector along the fastener toward the friction member.

10. The connector assembly of claim 9, wherein the friction member is received within one of the connector and the first extension and the biasing member is received within one of the connector and the second extension.

11. The connector assembly of claim 9, wherein the biasing member is a coil spring.

12. The connector assembly of claim 11, wherein the coil spring includes waves.

13. The connector assembly of claim 9, wherein the friction member is made of a material selected from the group consisting of an elastomer, a composite material, and a textured material.

14. The connector assembly of claim 9, wherein the base is operatively connected to a safety harness.

15. A positionable connector assembly, comprising:

a base including a first extension and a second extension;

a connector operatively connected to the base, the connector including a connector portion pivotally connected to the base between the first extension and the second extension;

a friction member positioned between the base and the connector;

a biasing member operatively connected to the connector and configured and arranged to bias the connector toward the friction member;

wherein the friction member is positioned between the first extension and the connector and the biasing member is positioned between the second extension and the connector, and wherein the friction member is received within one of the connector and the first extension and the biasing member is received within one of the connector and the second extension.

16. The connector assembly of claim 15, wherein a fastener extends through the first extension, the friction member, the connector portion, the biasing member, and the second extension, the connector pivoting about the fastener.

17. The connector assembly of claim 15, wherein the base is operatively connected to a safety harness.

* * * * *